US007695030B2

(12) United States Patent
Balbo Di Vinadio

(10) Patent No.: US 7,695,030 B2
(45) Date of Patent: Apr. 13, 2010

(54) SAFETY DEVICE AGAINST FALSE MANEUVERS FOR SLIDING WINDOW AND DOOR FRAMES

(75) Inventor: Aimone Balbo Di Vinadio, Turin (IT)

(73) Assignee: SAVIO S.p.A., Chiusa San Michele (Torino) (IT)

( * ) Notice: Subject to any disclaimer, the term of this patent is extended or adjusted under 35 U.S.C. 154(b) by 209 days.

(21) Appl. No.: 11/548,449

(22) Filed: Oct. 11, 2006

(65) Prior Publication Data

US 2007/0130836 A1 Jun. 14, 2007

(30) Foreign Application Priority Data

Oct. 31, 2005 (IT) ..... TO05A0773

(51) Int. Cl.
*E05C 1/04* (2006.01)
*E05C 19/10* (2006.01)

(52) U.S. Cl. ..... 292/150; 292/106; 292/302; 292/DIG. 46

(58) Field of Classification Search ..... 292/137, 292/102, 106, 146, 150, 155, 302, 350, DIG. 20, 292/DIG. 47, DIG. 54, DIG. 60, DIG. 46; 70/89, 90; 49/449
See application file for complete search history.

(56) References Cited

U.S. PATENT DOCUMENTS 372,645 A * 11/1887 Tweeddale ..... 292/155
2,736,185 A * 2/1956 Collar ..... 70/100
3,437,363 A * 4/1969 Walters ..... 292/113
3,714,738 A * 2/1973 Koslow et al. ..... 49/404
5,143,412 A * 9/1992 Lindqvist ..... 292/200
6,000,734 A * 12/1999 Prevot et al. ..... 292/99

FOREIGN PATENT DOCUMENTS

EP 0 881 347 A1 12/1988
EP 389448 A2 * 9/1990
EP 0 757 146 A1 2/1997
FR 2 743 388 A1 7/1997

OTHER PUBLICATIONS

European Search Report for corresponding European Patent Application No. 06122603.1, dated Mar. 29, 2007.

* cited by examiner

*Primary Examiner*—Peter M Cuomo
*Assistant Examiner*—Alyson M Merlino
(74) *Attorney, Agent, or Firm*—Heslin Rothenberg Farley & Mesiti P.C.; Victor A. Cardona, Esq.

(57) ABSTRACT

Described herein is a safety device against false maneuvers for sliding window and door frames, including an arrest designed to prevent displacement of the catch of the mobile frame of the window or door frame from its inoperative position to the operative position of engagement with a corresponding striker of the fixed frame, in the condition for opening the window or door frame. The arrest with the corresponding thrust member, adjustable in a direction parallel to the direction of displacement of the arrest, is carried by a slide that is adjustable in a direction orthogonal to the direction of displacement of the arrest.

8 Claims, 6 Drawing Sheets

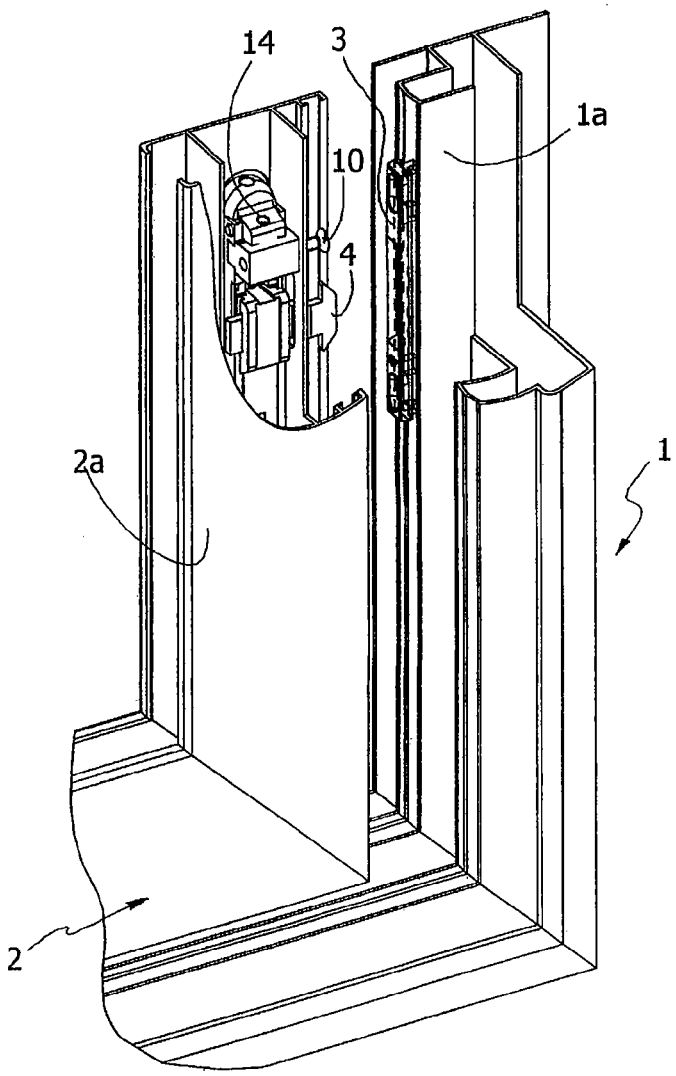
FIG. 1
FIG. 2
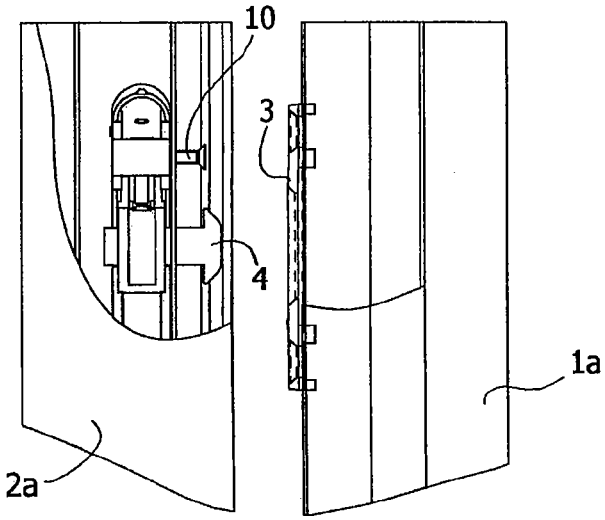

SAFETY DEVICE AGAINST FALSE MANEUVERS FOR SLIDING WINDOW AND DOOR FRAMES

CROSS REFERENCE TO RELATED APPLICATIONS

This application is a claims priority from Italian Patent Application No. TO2005A000773 filed on Oct. 31, 2005, the entire disclosure of which is incorporated herein by reference.

FIELD OF THE INVENTION

The present invention relates in general to sliding window and door frames, which include a fixed frame and a mobile frame bearing, in a position corresponding to respective facing vertical sides, respectively, a stationary striker, and a catch, which can be displaced vertically between an operative position, in which it engages said striker for blocking the mobile frame in a condition of closing, and an inoperative position corresponding to its disengagement from said striker to enable opening of the mobile frame.

STATE OF THE PRIOR ART

It is known to equip sliding window and door frames of this sort with a safety device to prevent possible false, i.e., wrong maneuvers by users, in particular in the case where, after the window or door frame has been opened, the catch is inadvertently brought back into the operative position. In said eventuality, the re-closing of the window or door frame would produce an inevitable impact between the catch and the striker of the fixed frame, which could jeopardize proper operation of the system of opening and closing of the window or door frame. Said safety device typically includes an arrest which can be displaced with respect to the mobile frame, against the action of elastic means of contrast, from an advanced position, in which it prevents displacement of the catch from the inoperative position to the operative position, to a retracted position, in which it enables said displacement. The arrest is moved via a thrust member that is connected to it in an adjustable way and projects from the mobile frame to bear upon the fixed frame in such a way as to move the arrest from the advanced position to the retracted position following upon closing of the window or door frame. In this way, when the mobile frame of the window or door frame is slid open, the catch is kept blocked in its inoperative position until the window or door frame is re-closed again.

In window and door frames of the above sort there exists the problem of adjusting the safety device appropriately, at the moment of installation of the sliding window or door frame, according to the distance between the mobile frame and the fixed frame in the condition of closing of the window or door frame. Said distance can in fact vary, for example, on account of imprecision of machining and also of installation of the window or door frame.

Currently, the only possibility of adjustment is the one afforded by the thrust member of the arrest, typically constituted by a screw, which, when screwed more or less with respect to the arrest (and hence with respect to the mobile frame of the window or door frame), enables adjustment by a certain amount of the distance between the two frames in the closing position. This in practice enables compensation only of the normal machining tolerances of the window or door frame, but not of possible defects of construction and/or installation that are more important, as well as, more in particular, of geometrical differences of the various types of profile used for the fabrication of the frames of the window or door frame that could give rise to more important errors or differences in the distance between the fixed and mobile frames in the condition of closing of the window or door frame.

SUMMARY OF THE INVENTION

The purpose of the present invention is to overcome the aforesaid drawback, and said purpose is achieved via a safety device against false maneuvers for sliding window and door frames of the type defined above, the essential characteristic of which lies in the fact that the position of said arrest is adjustable in a direction orthogonal to its direction of displacement between said advanced position and said retracted position.

Thanks to the above idea of solution, at the moment of installation of the window or door frame the position of the thrust member with respect to the mobile frame can be adapted in an extremely precise way not only longitudinally (i.e., in the direction of displacement of the mobile frame) as a result of its own adjustment, but also transversely (i.e., in a direction orthogonal to the direction of displacement of the mobile frame), so varying the position of the arrest, which enables compensation not only of the normal machining tolerances of the window or door frame, but also meeting of different geometrical requirements due to the shapes and dimensions themselves of the profile with which the window or door frame is made and to overcome also possible more important defects of machining or installation of the window or door frame that could lead to possible misalignments in a transverse direction between the thrust member and the fixed frame.

According to a preferred embodiment of the invention, the arrest is carried, with the corresponding elastic means of contrast, by a slide mounted so that it can slide within the mobile frame and can be blocked with respect to the latter in positions which can be selectively set.

BRIEF DESCRIPTION OF THE DRAWINGS

The invention will now be described in detail with reference to the annexed plate of drawings, which is provided purely by way of non-limiting example and in which:

FIG. 1 is a partial, schematic, and partially interrupted, view of a sliding window or door frame equipped with a safety device against false maneuvers according to the invention;

FIG. 2 is a partial view in elevation of FIG. 1;

DETAILED DESCRIPTION OF THE INVENTION

Figure 3:
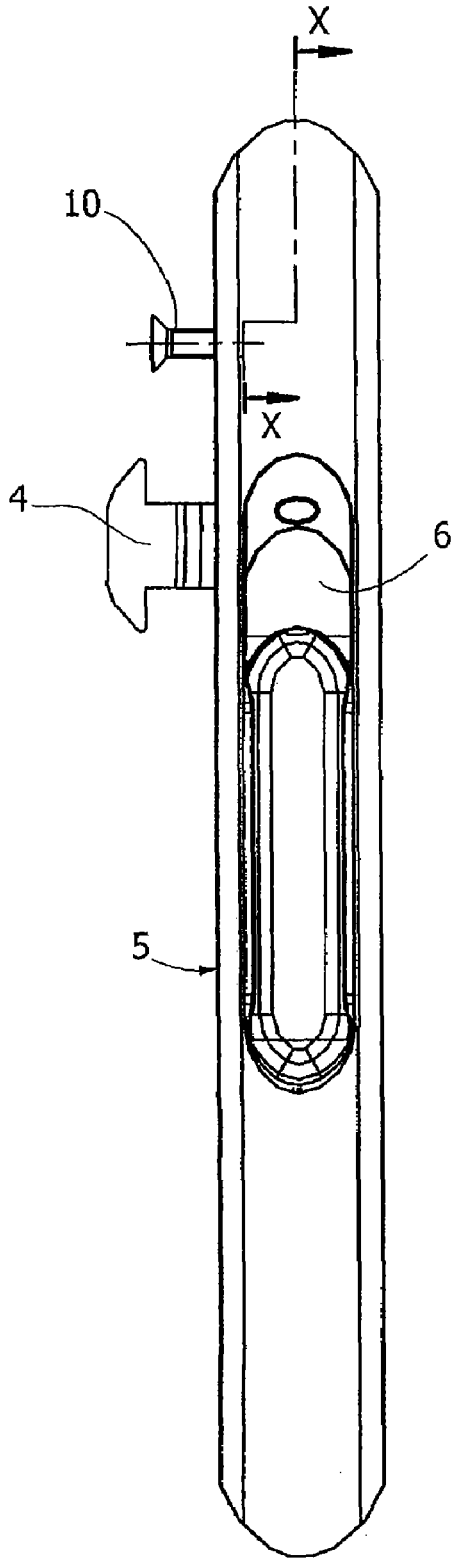
FIG. 3 is a view, in elevation and at a larger scale, of a detail of the mobile frame of the sliding window or door frame represented in FIGS. 1 and 2, rotated through 180°.
Figure 4:
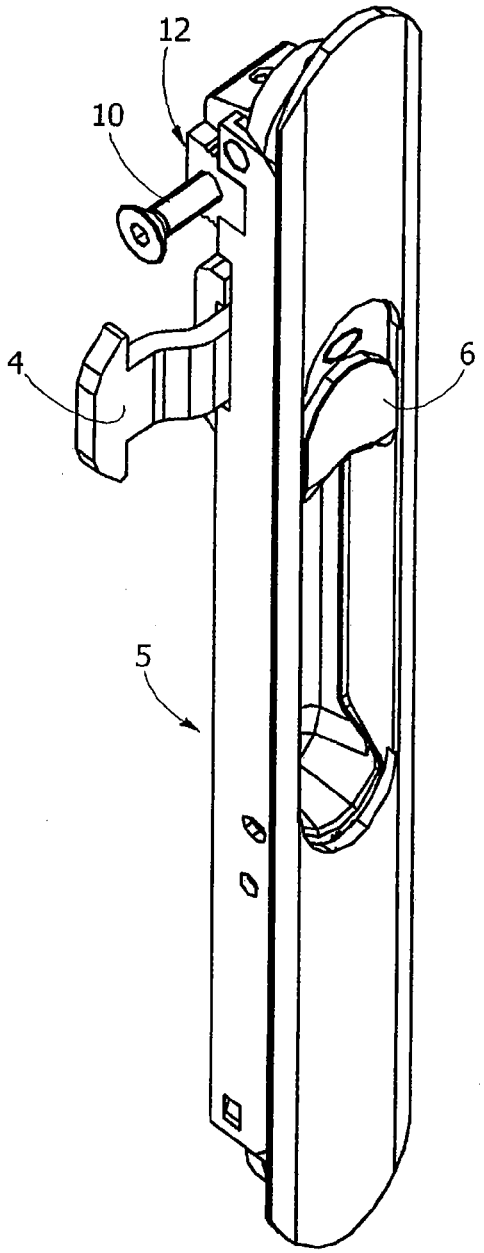
FIG. 4 is a perspective view at a reduced scale of FIG. 3.
Figure 5:
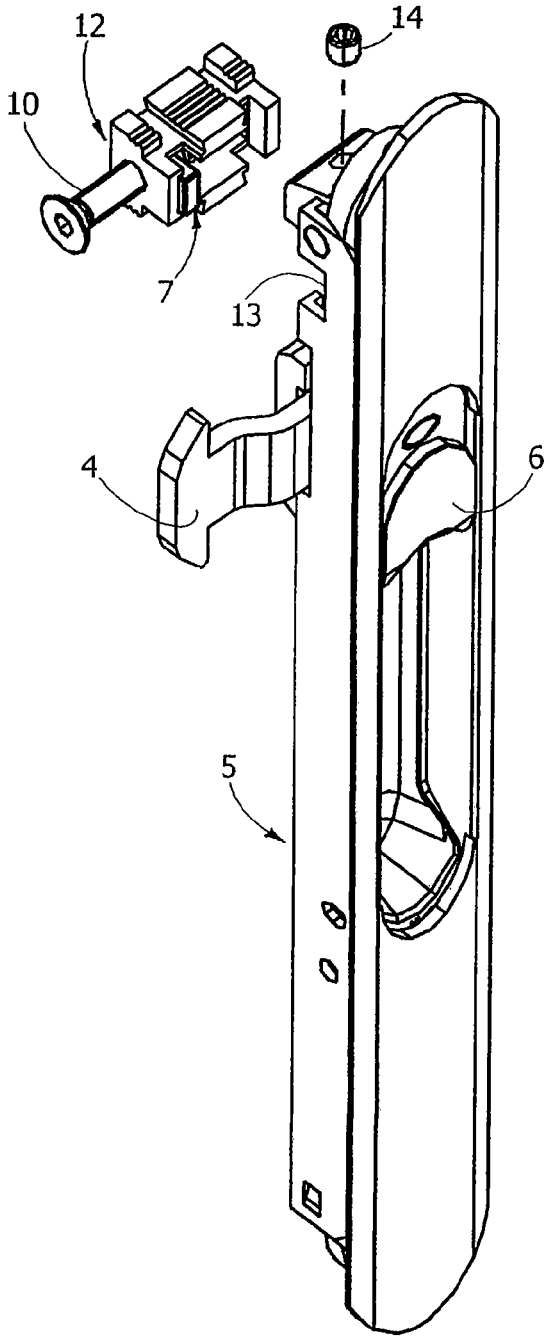
FIG. 5 is a partially exploded view of FIG. 4.
Figure 6:
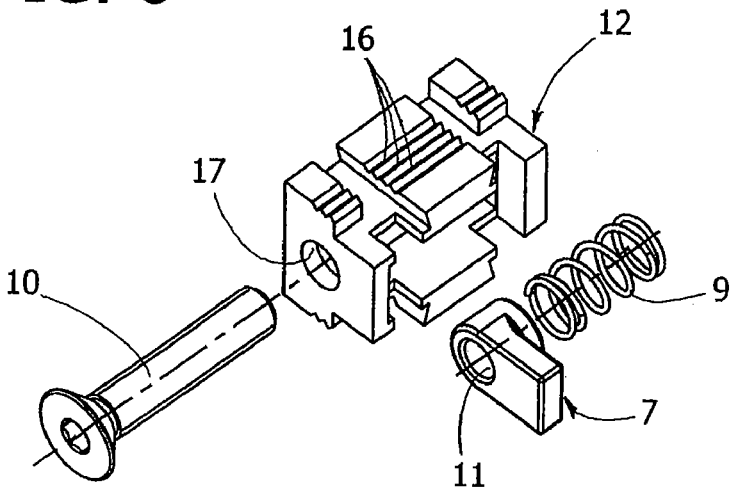
FIG. 6 is an exploded view at a larger scale of a detail of FIG. 5.

With initial reference to FIGS. 1 and 2, the numbers 1 and 2 designate, respectively, part of the fixed frame and part of the mobile frame of a sliding window or door frame. The fixed frame 1 is equipped, in a position corresponding to one of its vertical uprights 1*a*, with a generally conventional stationary striker 3, referred to as striker-plate, with which a catch 4 carried by a tray-like body 5 inserted into the corresponding vertical upright 2*a* of the mobile frame 2 is designed to co-operate also in a known way.

The catch 4, actuated by a sliding manual control element 6 carried at the front by the tray-like body 5, can be displaced vertically between a lowered, inoperative, position (represented in FIGS. 1 to 5 and FIGS. 7, 8, 10 and 11), in which it is lower than the stationary striker 3 and hence does not engage it, and a raised, operative, position (represented in FIG. 9), in which it engages the stationary striker 3. The operative position of the catch 4 corresponds to blocking the mobile frame 2 closed with respect to the fixed frame 1, whereas, in the inoperative position of said catch 4, the mobile frame 2 can be slid open.

Associated to the catch 4 is a safety device against false maneuvers, the function of which is that to guarantee that, when the catch 4 is set in its inoperative position to enable opening of the window or door frame, it is kept in said position until the mobile frame 2 is re-closed again against the fixed frame 1. Conversely, as has been said, if the mobile frame 2 were to be re-closed against the fixed frame 1 without having previously brought the catch 4 back into its inoperative position, this would inevitably produce a front impact of the catch itself against the striker 3, with the risk of irreparably jeopardizing correct operation during closing of the window or door frame.

The safety device in question comprises, in a conceptually known way, an arrest 7, illustrated in detail in FIGS. 6 to 11, which is carried by the tray-like body 5 above a (single or double) appendage 8, projecting upwards, of the sliding body bearing the catch 4. Said arrest 7 is able to move horizontally, against the action of a contrast spring 9, from an advanced position (represented in FIGS. 1 to 4 and FIG. 7), in which it prevents displacement upwards of the appendage 8 and hence does not enable movement upwards of the catch 4 from the inoperative position to the operative position, to a retracted position (represented in FIGS. 8 and 9), in which it does not interfere with the appendage 8 and hence enables the catch 4 to be moved from the inoperative position to the operative position.

The spring 9 normally keeps the arrest 7 in the advanced position: its translation into the retracted position, against the action of the spring 9, is brought about automatically by a thrust member 10 projecting from the upright 2*a* of the mobile frame 2 towards the upright 1*a* of the fixed frame 1, above the catch 4. When the mobile frame 2 is closed with respect to the fixed frame 1, the thrust member 10 is made to recede, causing the corresponding recession of the arrest 7, which thus enables displacement of the catch 4 from its inoperative position to the operative position, where it is engaged with the stationary striker 3. In this way, the window or door frame is blocked during closing.

In a way generally in itself known, the thrust member 10 is constituted by a screw engaged within a threaded hole 11 of the arrest 7. By screwing or unscrewing said screw 10 it is evidently possible to vary its projection from the mobile frame 2 so as to compensate, at the moment of installation of the window or door frame, for the normal machining tolerances. An adjustment of this sort is, however, insufficient to compensate for possible more important defects of fabrication or installation of the window or door frame, either geometrical differences or differences of shape, of the various types of profile used for the fabrication of the frames of the window or door frame that could give rise to more important errors or differences in the distance between the uprights 1*a* and 2*a* in the condition of closing of the window or door frame.

To solve the above problem, the invention envisages an implementation of the safety device against false maneuvers described above, the peculiarity of which lies in the fact that the arrest 7 is adjustable in a direction orthogonal (i.e., in a horizontal transverse direction) to the direction of its displacement between the aforesaid advanced position and retracted position. In other words, the arrest 7 can be translated laterally with respect to the tray-like member 5, and hence to the upright 2*a* of the mobile frame 2, so as to compensate effectively for the defects or the geometrical differences mentioned previously, at the moment of installation of the window or door frame. There are thus made available two adjustments: one carried out by screwing or unscrewing of the thrust screw 10, and the other made with the modalities referred to in what follows by means of displacement of the arrest 7 in a direction orthogonal to the screw 10.

With reference now in greater detail to FIGS. 5 to 11, the arrest 7 is housed so that it can slide with the corresponding contrast spring 9, so as to be able to move between the advanced and retracted positions mentioned previously, within a slide designated as a whole by 12, which is in turn supported by the tray-like body 5 translatable in a way orthogonal to the direction of sliding of the arrest 7. In detail, the slide 12 is mobile within a seat 13 of the tray-like body 5 and can be blocked, following upon its adjustment in the optimal position, via a threaded grub screw 14 screwed within a threaded hole 15 of the same tray-like body 5. For this purpose, the slide 12 is formed with a series of parallel grooves 16 set alongside one another, defining respective teeth arranged on the same side as the threaded grub screw 14 and set alongside one another in a direction orthogonal to the direction of displacement of the arrest 7. By unscrewing the threaded grub screw 14, the slide 12 can be displaced laterally in one direction (FIG. 10) or in the opposite direction (FIG. 11) up to the desired position, after the threaded grub screw 14 has been tightened home, engaging the corresponding groove 16.

The thrust screw 10 engaged in the threaded hole 11 of the sliding arrest 7 freely traverses a front opening 17 (FIG. 6) of the slide 12 to enable it to be more or less screwed.

According to the peculiar aspect of the invention, the position of the arrest 7 is hence adjustable in a direction transverse to its direction of displacement between the advanced and retracted positions, which enables, in addition to the adjustment afforded by the thrust screw 10, also a precision adjustment in relation to the alignment between the mobile frame 2 and the fixed frame 1, which, as has been said, can vary even considerably according to the types of profiles used for their fabrication.

Figure 7:
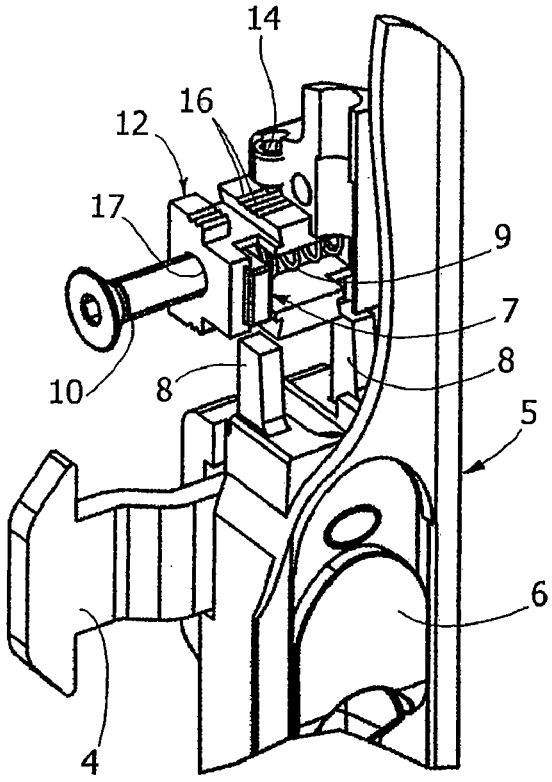
FIG. 7 shows at a larger scale a detail of FIG. 4 in a first condition of operation.
Figure 8:
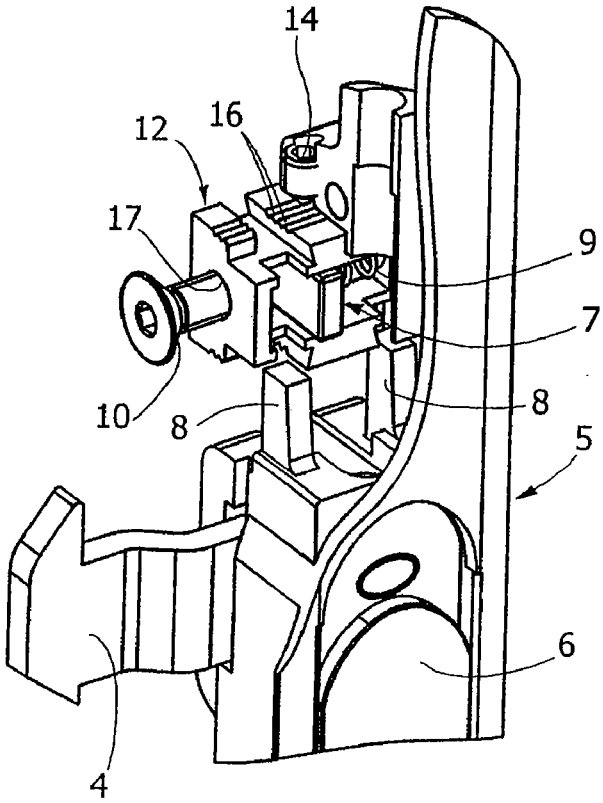
FIGS. 8 and 9 are two views similar to that of FIG. 7 in two different conditions of operation.
Figure 9:
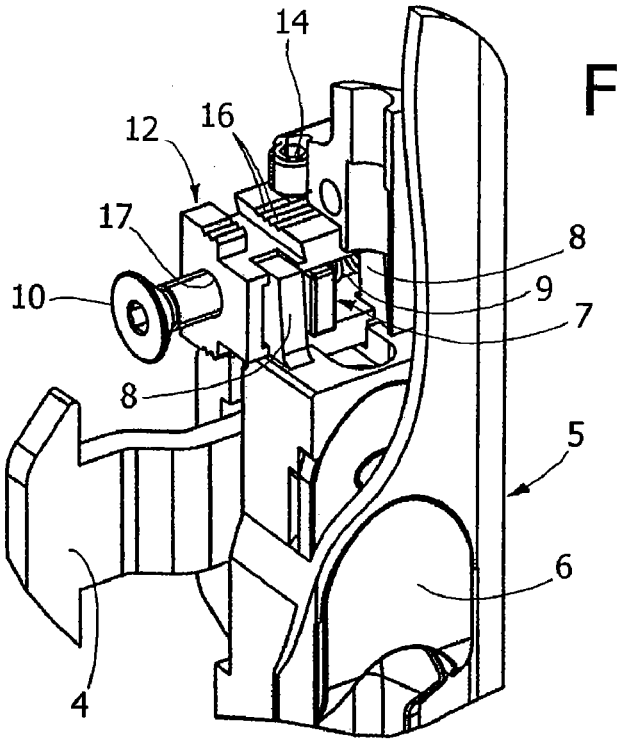
Figure 10:
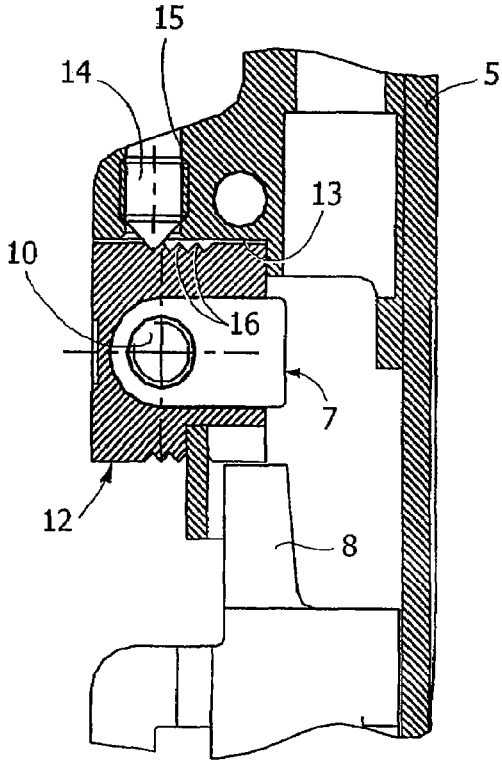
FIG. 10 is a cross-sectional view at a larger scale according to the line X-X of FIG. 3, which shows a first condition of adjustment.
Figure 11:
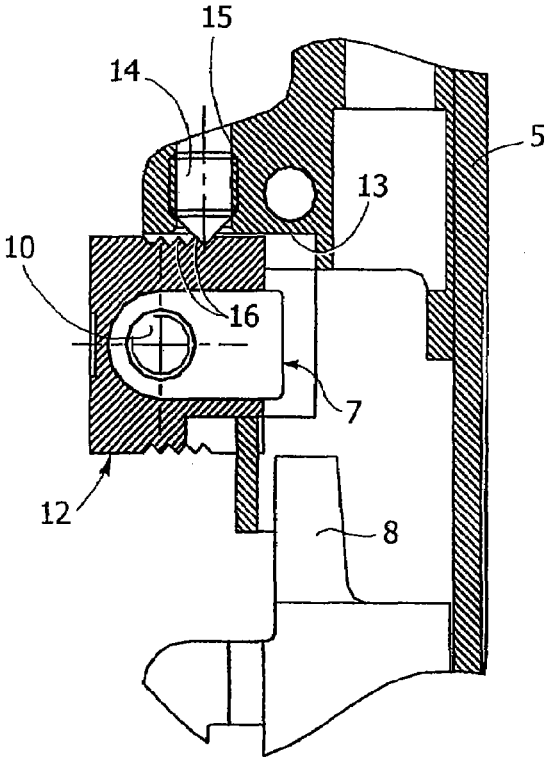
FIG. 11 is a view similar to that of FIG. 10, which shows a second condition of adjustment.

FIGS. 7, 8 and 9 exemplify the operation of the safety device according to the invention. FIG. 7 illustrates the condition for opening the mobile frame. In said condition, the catch 4 is set in its lowered, inoperative, position, and the arrest 7 is kept by the thrust spring 9 in its advanced position, with the thrust screw 10 set in the condition of maximum projection. Said screw 10 and the slide 12 bearing the arrest 7 will be adjusted in an optimal way, with the modalities clarified previously. Displacement of the catch 4 towards its raised, operative, position via the actuation of the sliding control element 6 is prevented by the arrest 7, which in this case is vertically aligned with respect to the appendage 8 of said catch 4.

When the window or door frame is closed, the contrast between the thrust screw 10 and the fixed frame 1 causes displacement of the arrest 7 from the advanced position to the retracted one against the action of the spring 9, in the way represented in FIG. 8. Consequently, the appendage 8 of the catch 4 is rendered free to move upwards.

This hence enables displacement of the catch 4 from the lowered, inoperative, position to the raised, operative, position, via the sliding control element 6, in the way represented in FIG. 9. Consequently, in this way the catch 4 engages with the stationary striker 3 so as to prevent re-opening of the window or door frame until the sliding control element 6 is again displaced downwards.

Of course, the details of construction and the embodiments may vary widely with respect to what is described and illustrated herein, without thereby departing from the scope of the present invention, as defined in the ensuing claims.

What is claimed is:

1. A safety device system preventing false maneuvers of sliding window and door frames which comprises:

a fixed frame and a mobile frame of a window or door, which bear, in a position corresponding to respective facing vertical uprights, a stationary striker and a catch, said catch configured to be displaced vertically between an operative position in which said catch engages with said striker for blocking said mobile frame with respect to the fixed frame in a closing condition, and an inoperative position corresponding to the disengagement of said catch from said striker to enable opening of said mobile frame, and safety means to prevent displacement of said catch to said operative position until said mobile frame is re-closed with respect to the fixed frame, said safety means including an arrest and an elastic means received in a cavity of a slide, said slide comprising a plurality of walls bounding said cavity, said arrest displaceable within said cavity of said slide and with respect to said mobile frame, against the action of said elastic means, from an advanced position in which said arrest blocks said catch in said inoperative position, to a retracted position in which said arrest enables displacement of said catch into said operative position, and a thrust member adjustably connected to said arrest and projecting from said mobile frame to bear upon said fixed frame so as to move said arrest from said advanced position to said retracted position following upon closing of said mobile frame relative to said fixed frame, wherein said slide is adjustably movable from a first position to a second position within a seat of said mobile frame in a direction orthogonal to the direction of the displacement of said arrest between said advanced and retracted positions, and wherein said catch comprises an upwardly projecting appendage, said slide comprising a slot in a wall of said plurality of walls to allow displacement of said appendage therein into said operative position when said arrest is in said retracted position.

2. The system according to claim 1, wherein said slide is slidably mounted within said mobile frame and said slide is selectively blockable with respect to the mobile frame in a at least one of said first position and said second position.

3. The system according to claim 2, wherein said slide has a series of grooves directed parallel to the direction of displacement of said arrest between the advanced position and the retracted position, and said grooves aligned parallel to one another, said grooves being selectively engageable by a blocking member carried by said mobile frame to allow said slide to be selectively blocked.

4. The system according to claim 3, wherein said adjustable thrust member consists of a screw that traverses a front opening of said slide and engages a corresponding threaded hole of said arrest.

5. The system according to claim 1, wherein the displacement of the arrest between the advanced and retracted positions is about parallel to a longitudinal dimension of the catch.

6. The system of claim 1 wherein said slide is adjustably movable within said seat in a direction orthogonal to a longitudinal dimension of said mobile frame.

7. The system of claim 1 wherein said thrust member extends through an opening of said slide to connect to said arrest.

8. A safety device system for sliding window and door frames, the device comprising:

a fixed frame and a mobile frame of a window or door, which bear, in a position corresponding to respective facing vertical uprights, a stationary striker and a catch, said catch configured to be displaced vertically between an operative position in which said catch engages with said striker for blocking said mobile frame with respect to the fixed frame in a closing condition, and an inoperative position corresponding to the disengagement of said catch from said striker to enable opening of said mobile frame, and safety means to prevent displacement of said catch to said operative position until said mobile frame is re-closed with respect to the fixed frame, said safety means including an arrest and an elastic means received in a cavity of a slide, said slide comprising a plurality of walls bounding said cavity;

said catch comprising an upwardly projecting appendage, said slide comprising a slot in a wall of said plurality of walls to allow displacement of said appendage therein;

said arrest displaceable within said cavity of said slide and with respect to said mobile frame against the action of said elastic means from an advanced position in which said arrest blocks upward movement of said appendage of said catch into said slot in said inoperative position, to a retracted position in which said arrest enables upward movement of said appendage of said catch into said slot into said operative position; and a thrust member adjustably connected to said arrest and projecting from said mobile frame to bear upon said fixed frame so as to move said arrest from said advanced position to said retracted position following upon closing of said mobile frame relative to said fixed frame.

* * * * *